United States Patent [19]

Terasawa et al.

[11] Patent Number: 5,053,787

[45] Date of Patent: Oct. 1, 1991

[54] INK JET RECORDING METHOD AND HEAD HAVING ADDITIONAL GENERATING MEANS IN THE LIQUID CHAMBER

[75] Inventors: Koji Terasawa, Mitaka; Hideki Yamaguchi, Yokohama, both of Japan

[73] Assignee: Canon Kabushiki Kaisha, Tokyo, Japan

[21] Appl. No.: 625,705

[22] Filed: Dec. 11, 1990

Related U.S. Application Data

[63] Continuation of Ser. No. 303,257, Jan. 26, 1989.

[51] Int. Cl.[5] ..... B41J 2/05; B41J 2/055; B41J 2/165

[52] U.S. Cl. ..... 346/1.1; 346/140 R

[58] Field of Search ..... 346/1.1, 140

[56] References Cited

U.S. PATENT DOCUMENTS

| | | | |
|---|---|---|---|
| 3,925,788 | 12/1975 | Kashio . | |
| 3,925,789 | 12/1975 | Kashio . | |
| 4,123,761 | 10/1978 | Kimura et al. | 346/140 R |
| 4,176,363 | 11/1979 | Kasahara . | |
| 4,183,030 | 1/1980 | Kaieda et al. . | |
| 4,251,824 | 2/1981 | Hara et al. . | |
| 4,276,554 | 6/1981 | Terashawa | 346/140 |
| 4,296,421 | 10/1981 | Hara | 346/140 R |
| 4,338,611 | 7/1982 | Eida et al. . | |
| 4,345,262 | 8/1982 | Shirato et al. . | |
| 4,463,359 | 7/1984 | Ayata et al. . | |
| 4,466,005 | 8/1984 | Yoshimura . | |
| 4,514,742 | 4/1985 | Suga et al. | 346/140 |
| 4,600,931 | 7/1986 | Terasawa . | |
| 4,646,105 | 2/1987 | Matsumoto et al. . | |
| 4,646,110 | 2/1987 | Ikeda et al. | 346/140 R |
| 4,672,398 | 6/1987 | Kuwabara | 346/140 |
| 4,719,472 | 1/1988 | Arakawa | 346/140 |

FOREIGN PATENT DOCUMENTS

| | | |
|---|---|---|
| 169657 | 7/1987 | Japan . |
| 62-240558 | 10/1987 | Japan . |
| 2159465 | 12/1985 | United Kingdom . |

*Primary Examiner*—Joseph W. Hartary

*Attorney, Agent, or Firm*—Fitzpatrick, Cella, Harper & Scinto

[57] ABSTRACT

In a discharge recovery method for an ink jet recording head, a recording head having discharge openings for discharging ink therethrough, liquid paths in which recording energy generating members generating energy for discharging the ink through the discharge openings are provided and which communicate with the discharge openings, and a liquid chamber communicating with the liquid paths for supplying the ink to the liquid paths is used to drive heat energy generating means provided in the liquid chamber for generating heat energy for causing a change in the state of the ink in the liquid chamber and creating a bubble, during nonrecording, thereby causing the ink to be discharged through the discharge openings.

27 Claims, 6 Drawing Sheets

INK JET RECORDING METHOD AND HEAD HAVING ADDITIONAL GENERATING MEANS IN THE LIQUID CHAMBER

This application is a continuation of application Ser. No. 07/303,257 filed Jan. 26, 1989, now abandoned.

BACKGROUND OF THE INVENTION

1. Field of the Invention

This invention relates to a discharge recovery method for an ink jet recording head provided with discharge recovery means for recovering unsatisfactory discharge of ink from the discharge openings of the ink jet recording head.

2. Related Background Art

An ink jet recording apparatus is such that ink is supplied into a recording head, a drive element provided correspondingly to at least one ink discharge opening formed in the front surface of the recording head is driven on the basis of a recording,.data signal to thereby cause the ink to be discharged through the ink discharge opening and form a flying liquid droplet toward a recording medium. Such liquid droplet is caused to adhere to the recording medium to thereby accomplish recording.

In the recording head of the ink jet recording apparatus of this type, unsatisfactory discharge is caused by the entry of air into a liquid path communicating with the ink discharge opening or the adherence of paper dregs or viscosity-increased ink in the liquid path. In order to eliminate such unsatisfactory discharge and achieve the stability of discharge, as shown, for example, in U.S. Pat. No. 4,600,931 issued to Terasawa and U.S. Pat. No. 4,123,761 issued to Kimura, a gear pump or the like has been provided in an ink supply path communicating with the recording head and supplying ink to thereby forcibly pressurize the ink and cause the air and foreign materials in the liquid path to be discharged. In addition a pump mechanism or the like for sucking air and foreign materials from the discharge opening by negative pressure and causing them to be discharged has been provided.

However, in the conventional recovery method for an ink jet recording head, it is necessary to discharge a great deal of ink to eliminate the air slightly stagnating in the liquid path or the viscosity-increased ink in the discharge opening and the liquid path. Also, much time is required for operating these drive systems (the pump, etc.) and as a result, it is necessary to stop recording temporarily, thus inefficiently wasting time.

Also, discretely from the above-described construction, a construction in which a drive element such as a piezoelectric element for discharge is driven during non-recording to thereby effect predischarge, as described, for example, in U.S. Pat. No. 3,925,788 issued to Kashio, U.S. Pat. No. 3,925,789 issued to Kashio, U.S. Pat. No. 4,183,030 issued to Kaieda et al., and U.S. Pat. No. 4,176,363 issued to Kasahara has been proposed However, in the above-described construction wherein pre-discharge is effected, the drive element used for recording is used also as the drive element for pre-discharge, and there have been technical tasks left to be solved in the points which will be described later.

In the pre-discharge of the above-described construction, the drive element is used for both purposes, and this is effective in the prevention of clogging or unsatisfactory discharge. But when unsatisfactory discharge has already occurred as may occur when recording is again effected from a long time of unused state, the effect of releasing is unsatisfactory.

Also, a construction in which the pre-discharge of the above-described construction is effected with the driving conditions or the like changed is shown, for example, in U.S. Pat. No. 4,466,005 issued to Yoshimura. However, in the construction described above in detail, there have been left the technical tasks that in the sense that the drive element is used for both purposes, there are cases where discharge recovery cannot be completely accomplished, and the technique which is effective because of a piezo-electric element being used as the drive element cannot be simply applied to a construction in which heat energy generating means generating heat energy is used as an element generating energy used for the discharge of ink.

SUMMARY OF THE INVENTION

It is an object of the present invention to overcome such technical tasks left to be solved in the prior art and to provide a recovery method for an ink jet recording head which can reduce the amount of ink consumed for discharge recovery and can shorten the recovery time.

It is another object of the present invention to provide an ink jet recording apparatus in which the life of a drive element for recording is prolonged and good recording can be effected for a long period of time.

It is still another object of the present invention to provide an ink jet recording head whose discharge openings can be recovered to a good state of discharge.

It is yet still another object of the present invention to provide an ink jet recording head which can accomplish good discharge recovery and which is compact and inexpensive.

DESCRIPTION OF THE PREFERRED EMBODIMENTS

Figure 1:
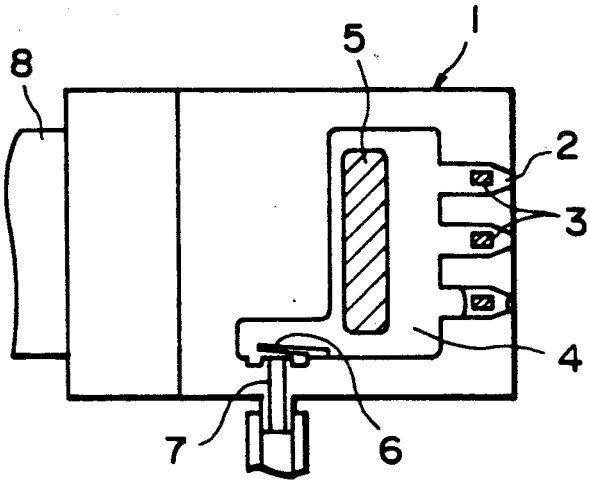
FIG. 1 is a cross-sectional view of an ink jet recording head to which the recovery method of the present invention is applied as it is seen from above.

The present invention will hereinafter be specifically described with reference to FIG. 1. FIG. 1 is a schematic cross-sectional view showing an ink jet recording head to which the recovery method of the present invention is applied.

Figure 2:
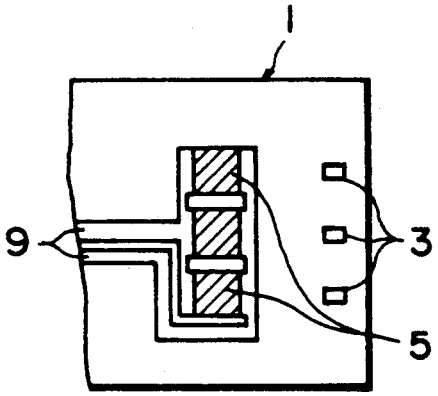
FIG. 2 is a schematic plan view showing the details of the heater board of the recording head of FIG. 1.

In FIG. 1, the reference numeral 1 designates a recording head carrying thereon various members which will be described later and discharging ink to recording paper or the like to thereby form ink droplets, the reference numeral 2 denotes a plurality of liquid paths provided in the fore end portion of the recording head 1, the reference numeral 3 designates heaters for recording as electro-thermal converting elements disposed at the bottom correspondingly to the liquid paths 2 and supplied with electric power during recording to generate heat energy utilized for ink discharge, the reference numeral 4 denotes a common liquid chamber communicating with the rear ends of the liquid paths 2 and supplying ink to them, the reference numeral 5 designates a heater for applying pressure disposed at the bottom of the common liquid chamber 4 as shown in FIG. 2, the reference numeral 6 denotes a check valve provided in an ink supply portion 7 for the common liquid chamber 4, the reference numeral 8 designates a flexible cable containing therein a driving signal line connected to each of the heaters 3 for recording, and the reference numeral 9 denotes a wiring portion connected to the heater 5 for applying pressure.

The present invention can be suitably applied to an ink jet recording apparatus of the type in which a recording head and an ink tank for containing therein ink to be supplied to the recording head are integrally and removably carried relative to a carriage. This is because in the apparatus of the above-described type in which a decrease in the amount of consumed ink and compactness of the apparatus are desired, limitation of the construction of recovery means is desired. Also, in such a head, the ink tank may be removably mounted.

The check valve 6 is made of plastic film, metal foil or a shape memorizing alloy on the boundary surface between the ink supply portion 7 and the common liquid chamber 4, and prevents the ink from flowing from the common liquid chamber 4 back to the ink supply portion 7 side when bubbles are made in the common liquid chamber 4 by the heater 5 for applying pressure. Where plastic film, metal foil or the like is used for the check valve 6, if the plate thickness is of the order of 50 μm, there will be obtained a check valve excellent in the responsiveness to the fluctuation of applied pressure.

In the above-described construction, the ink supplied from the ink supply portion 7 fills the common liquid chamber 4 and the liquid paths 2. During recording, the heater 5 for applying pressure is not supplied with electric ower on the basis of a signal generated by means for ıerating a recording signal, but only the heaters 3 for recording are supplied with electric power in conformity with the recording signal. On the surfaces of the heaters 3 for recording which have been supplied with electric power, bubbles are created by film boiling, and with these bubbles as the pressure force, ink droplets fly out from the fore ends of the liquid paths 2 toward recording paper. New ink is supplied into the liquid paths in which the bubbles have been produced, due to negative pressure created in the liquid paths with the flight of the ink droplets, and an amount of ink corresponding to the decrement is supplied form the ink supply portion 7 to the common liquid chamber 4 through the check valve 6.

Figure 3:
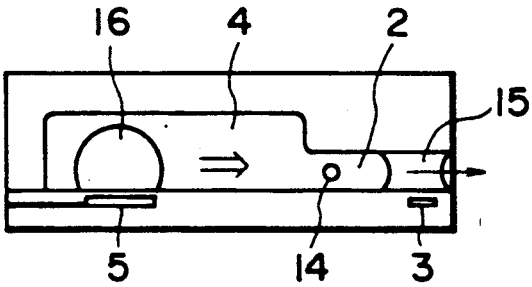
FIG. 3 is a schematic view illustrating the discharge recovery operation of the present invention.

Next, where the recovering operation is to be performed, when the supply of electric power to all of the heaters 3 for recording is stopped and electric power is supplied to the heater 5 for applying pressure on the basis of a pre-discharge signal generated by means for generating a pre-discharge signal, a bubble is created in the common liquid chamber 4 and pressure is applied to the interiors of the respective liquid paths 2 by the pressure resulting from the expansion of the bubble, and as shown in FIG. 3, the air 14, the remaining bubble 15 and the ink in the liquid paths 2 are forced out of the liquid paths 2, whereby clogging of the liquid paths can be eliminated. That is, energy is generated by the heater 5 to discharge liquid only in this non-recording, or recovery, mode. At the same time, the liquid pressure by the bubble created by the heater 5 for applying pressure presses the check valve 6 to thereby close the outlet of the ink supply portion 7 and prevent the back flow of the ink, thus enhancing the discharging force of the ink.

Figure 4:
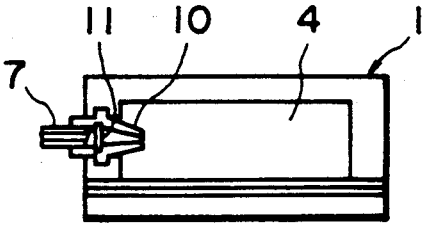
FIG. 4 is a schematic cross-sectional view showing another example of the check valve shown in FIG. 1.

The check valve is not restricted to the construction of FIG. 1, but may also be of a structure as shown in FIG. 4 wherein the fore end portion thereof is formed by an elastic member adapted to be closed by ink pressure and a filter 11 for removing any dust contained in the ink is provided in the ink paths. By doing so, any dust which may cause clogging of the discharge openings to be common liquid chamber 4 and of the liquid paths can be removed.

Figure 5:
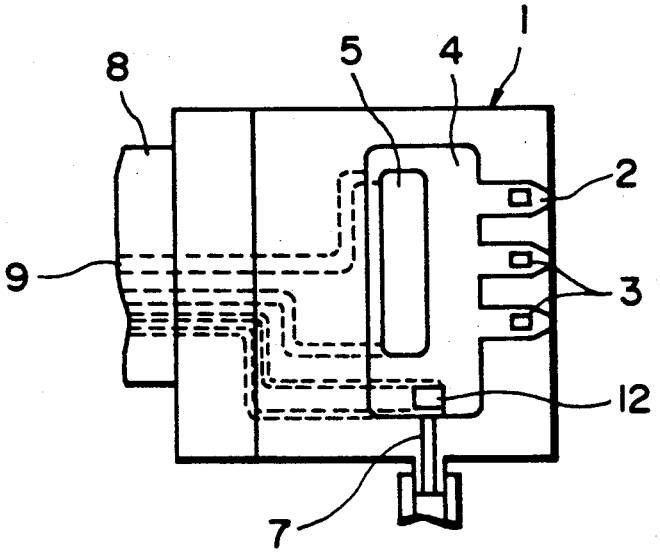
FIG. 5 is a schematic cross-sectional view of another embodiment of the ink jet recording head to which the recovery method of the present invention is applied as it is seen from above.
Figure 6:
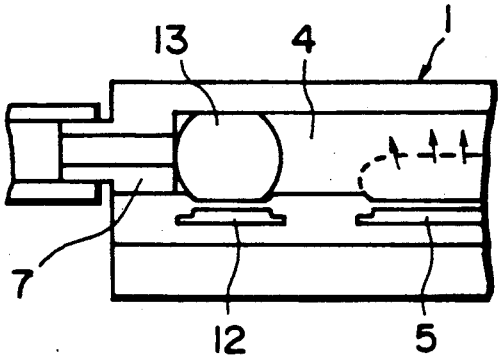
FIG. 6 is a schematic view for illustrating the operation of the back flow preventing structure of FIG. 5.

The check valve can also be designed as other constructions than a valve mechanism, as shown in FIG. 5. That is, a heater 12 for checking is provided on the bottom surface of the common liquid chamber 4 which is near the outlet of the ink supply portion 7. The reference numeral 9 designates a lead connected to the heater 5 for applying pressure and the heater 12 for checking In this case, when electric power is to be supplied to the heater 5 for applying pressure, electric power is supplied to the heater 12 for checking for the order of 10 μsec. to increase the heater temperature to several hundred degrees, and thereby film-boils the ink on the upper surface of the heater 5 for applying pressure. Thereby, a bubble 13 is created as shown in FIG. 6 and the outlet of the ink supply portion 7 can be closed. This bubble 13 disappears in 20–30 μsec. by cutting of the supply of electric power to the heater 12 for checking, and the subsequent supply of the ink to the common liquid chamber 4 can be accomplished without any hindrance.

Figure 7:
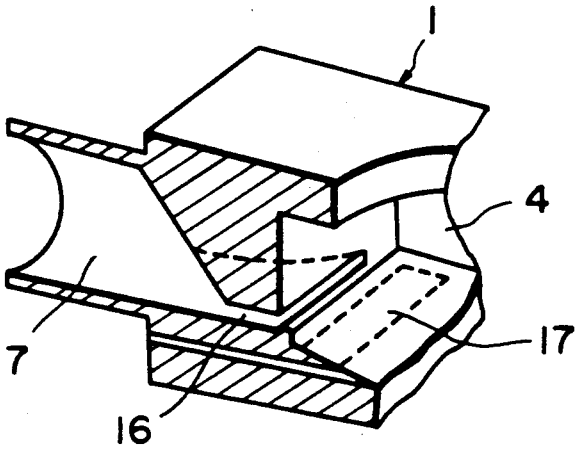
FIG. 7 is a schematic view showing another example of the back flow preventing structure of FIG. 5.

In the construction of FIG. 5, a slit opening 16 may be provided at the fore end of the ink supply portion 7, as shown in FIG. 7, and may be used instead of the heater 12 for checking having a length greater than the widthwise dimension of the slit opening. By adopting such a construction, the back flow to the ink supply portion 7 can be prevented even when the height of the bubble by the heater 17 for checking is low.

Figure 8:
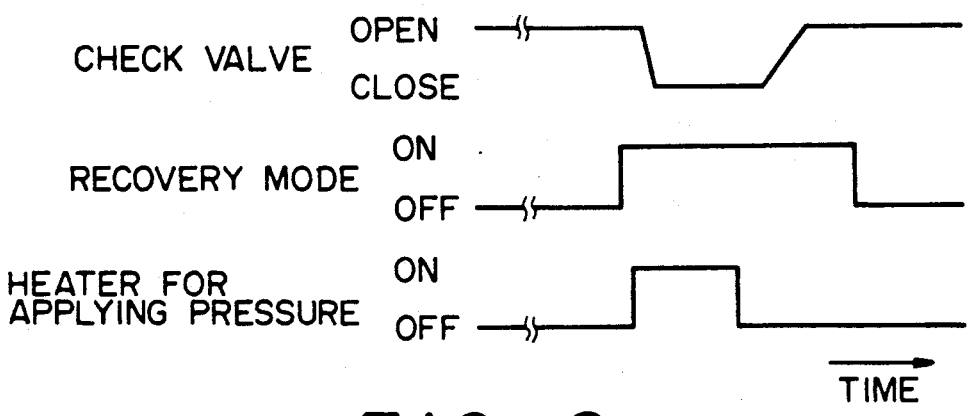
FIG. 8 is a timing chart showing the operation of the FIG. 1 embodiment.
Figure 9:
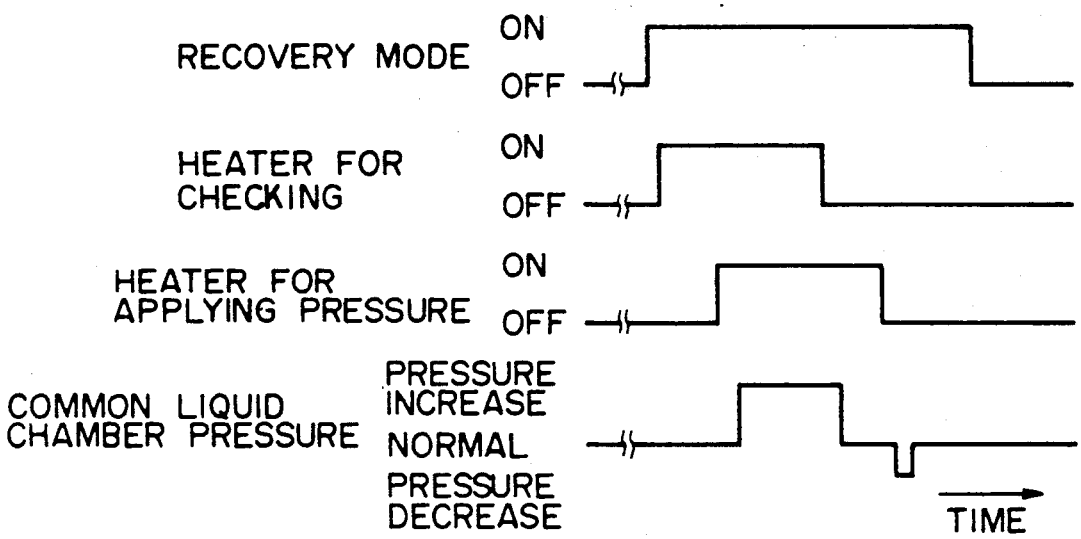
FIG. 9 is a timing chart showing the operation of the FIG. 5 embodiment.

The power supply timing of the heater 5 for applying pressure and the heater 12 for checking will now be described with reference to FIGS. 8 and 9. In FIG. 8, the recovery mode is automatically assumed after the switch operation of the recording apparatus during unsatisfactory discharge or a predetermined amount of discharging operation, whereby the heater 5 for applying pressure is heated and the check valve 6 is operated by a bubble resulting therefrom and the air, the remaining bubble, etc. in the liquid paths are removed as shown in FIG. 2. When the heater 5 for applying pressure is turned off, the created bubble begins to disappear and negative pressure begins to be created in the common liquid chamber 4. Thereby, the check valve 6 is opened and also, the retraction of the meniscus of the liquid paths 2 is prevented by the meniscus holding force of about 50 μm of the discharge openings and the low flow path resistance of the ink supply portion having a large diameter relative to the inner diameter of the discharge openings of the liquid paths.

The power supply timing of the heater 5 for applying pressure and the heater 12 for checking in the construction of FIG. 5 will now be described with reference to FIG. 9.

When the recovery mode assumes its ON state, the heater 12 for checking is supplied with electric power by means for generating a checking signal and a bubble 13 is created as shown in FIG. 6, whereby the ink supply to the common liquid chamber 4 is cut off. The heater 5 for applying pressure is then supplied with electric power to cause a bubble to be created in the common liquid chamber 4 as shown in FIG. 3, and the ink is forced into the respective liquid paths 2. At this point of time, the heater 12 for checking is turned off and the ink supply portion 7 is connected to the common liquid chamber 4. When the heater 5 for applying pressure is then turned off, the bubble thereby disappears and negative pressure is created and thus, the ink flows from the ink supply portion 7 into the common liquid chamber 4. Thereby, in the common liquid chamber 4, pressure is kept uniform with the meniscus of the discharge openings maintained.

The power supply timing of the heater 5 for applying pressure and the heater 12 for checking in the construction of FIG. 5 will now be described with reference to FIG. 10.

When the recovery mode assumes its ON state, the heater 12 for checking is supplied with electric power and a bubble 13 is created as shown in FIG. 6, whereby the ink supply to the common liquid chamber 4 is cut off. The heater 5 for applying pressure is then supplied with electric power to thereby cause a bubble to be created in the common liquid chamber 4 as shown in FIG. 3, and the ink is forced into the respective liquid paths 2. At this point of time, the heater 12 for checking is turned off and the ink supply portion is connected to the common liquid chamber 4. When the heater 5 for applying pressure is then turned off, the bubble thereby disappears and negative pressure is created, and the ink flows from the ink supply portion 7 into the common liquid chamber 4. Thereby, in the common liquid chamber 4, pressure is kept uniform with the meniscus of the discharge openings of the liquid paths maintained.

As described above, for the unsatisfactory discharge of the recording head, discharge recovery can be achieved by controlling only the heater in the common liquid chamber, and the amount of ink discharged from the discharge openings can be made very small. Also, since the present invention does not depend on any mechanical construction, the recovery time depends only on the refill of the ink and the operating time can be made very short, and can be kept within such a degree of time that the use of the recovery mode cannot be recognized by the user.

Figure 10:
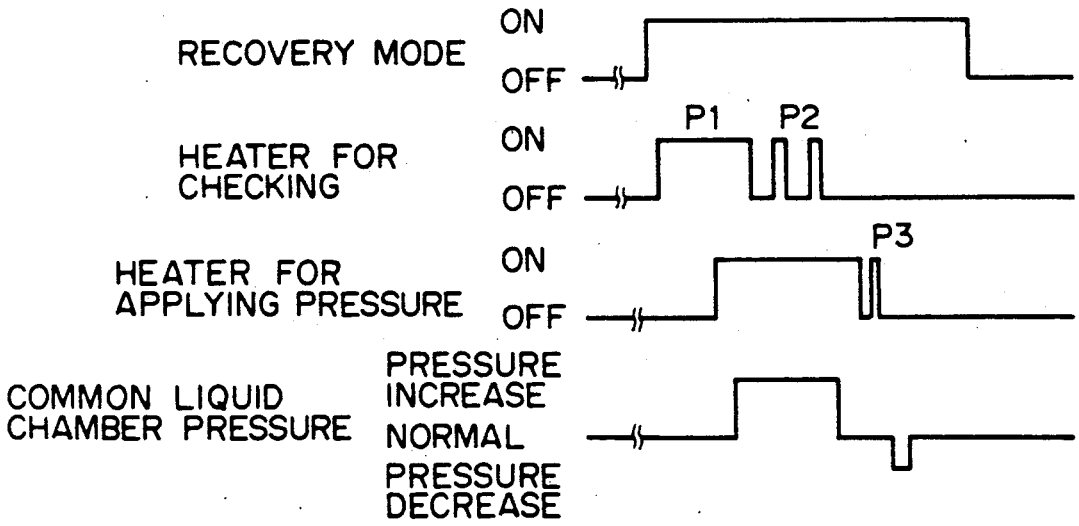
FIG. 10 is a timing chart which is another example of the timing shown in FIG. 9.

By controlling the heater 12 for checking during the supply of electric power thereto so that as shown in FIG. 10, it assumes a pulse P1 of continuous power supply during the turn-on thereof and a pulse P2 of short pulse width is assumed on the OFF side, it becomes possible to prevent overheating of the heater 12 for checking and slightly delay the disappearance of the bubble. As a result, the pressure applying effect by the heater 5 for applying pressure is enhanced and the control of the heating time becomes easy.

Likewise, by providing a short pulse P3 on the Off side during the supply of electric power to the heater 5 for applying pressure, it becomes possible to delay the disappearance of the bubble and it becomes possible to prevent overheating. The pulses P2 and P3 are chiefly directed to the maintenance of the temperature of the heater portion and therefore need not be as great as the heat energy during the formation of a bubble. The control of the supply of electric power can be accomplished not only by a method using a variation in the pulse width, but also by a reduction in the on-duty or a reduction in the voltage applied to the heater resistor.

The heaters for recording are designed such that as the condition of the input pulse for forming an ink droplet, they are controlled so that as shown in U.S. Pat. No. 4,345,262 issued to Shirato, the input cycle is at least three times a pulse width of 0.1 μsec.–500 μsec., but according to the present embodiment, by using the heater for applying pressure discretely from the heaters for recording, it becomes possible to apply a signal which is not subjected to said limitation, and this leads to the merit that the range of the selection of the driving condition of the heater for applying pressure becomes wider.

Figure 11:
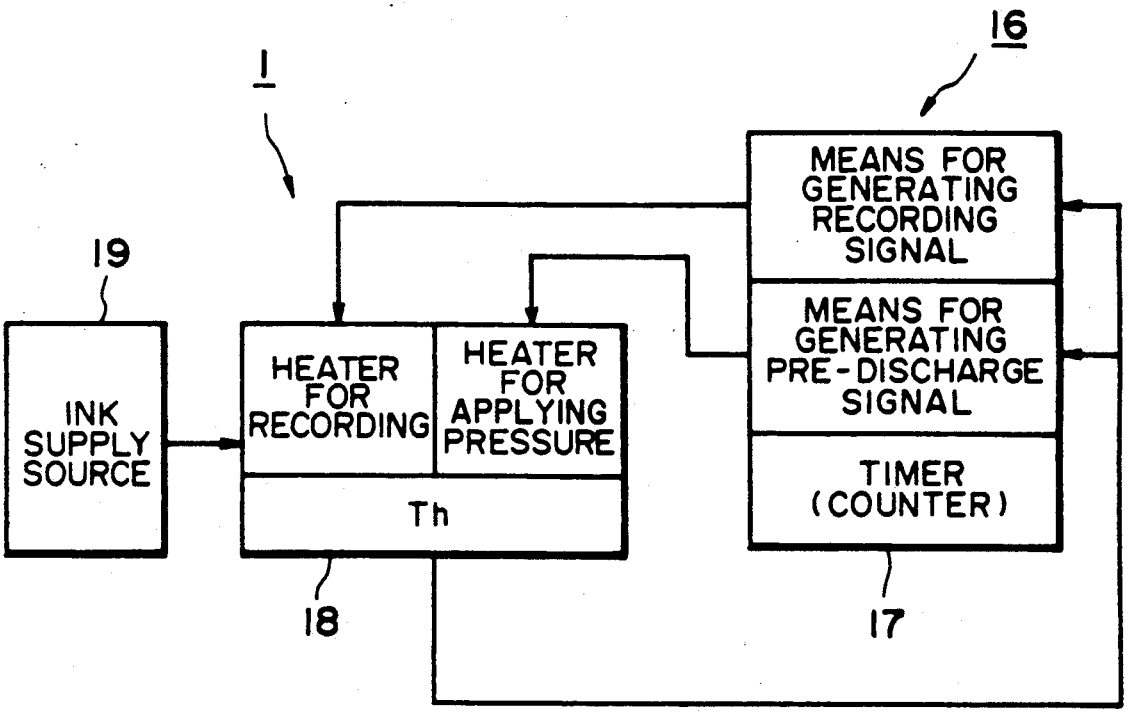
FIG. 11 is a block diagram schematically showing the structure of a control system for controlling the supply of electric power to heaters.

FIG. 11 schematically shows the construction of a control system for controlling the supply of electric power to the heaters. The output of a control unit 16 is connected to the heater 5 for applying pressure, and this control unit 16 uses the output signal of a temperature detecting thermistor (Th) 18 provided in the head 1 as a feedback signal and controls the power supply time by the set time of a timer 17. The reference numeral 19 designates an ink supply source.

Figure 12:
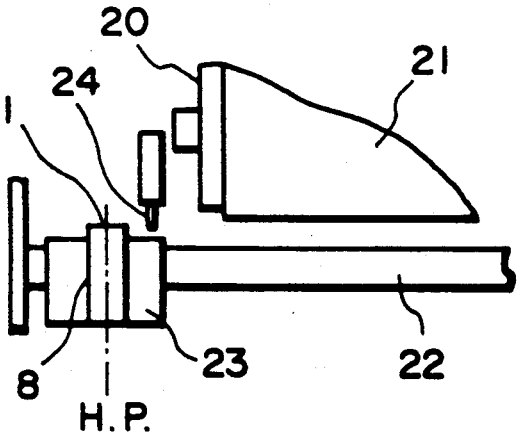
FIG. 12 is a schematic view showing portions of an ink jet recording apparatus for effecting the discharge recovery according to the present invention.

FIG. 12 shows the position of the head when discharge recovery is effected.

A platen 20 for conveying recording paper 21 as a recording medium in conformity with the printing situation is rotatably supported on the body, and a guide shaft 22 is fixedly disposed parallel to the front portion of the platen 20 and in a horizontal direction. A carriage 23 is slidably engaged with the guide shaft 22, and is reciprocally moved on the guide shaft 22 in conformity with the printing condition, with a carriage motor, not shown, as a drive source. The recording head 1 is mounted on the carriage 23, and discharge recovery is executed when the recording head 1 is in its home position (H.P.). The reference numeral 24 designates a wiping blade having a plate-like elastic member for wiping away the ink adhering to the surface of the head after the completion of the discharge recovery when the carriage 23 is moved.

As previously described, the discharge recovery operation according to the present invention is performed within a very short time and therefore, the time required for the discharge recovery operation, including the time required for returning the carriage 23 to its home position, may be less than one second. Accordingly, the user will experience virtually no interruption of recording.

Figure 13:
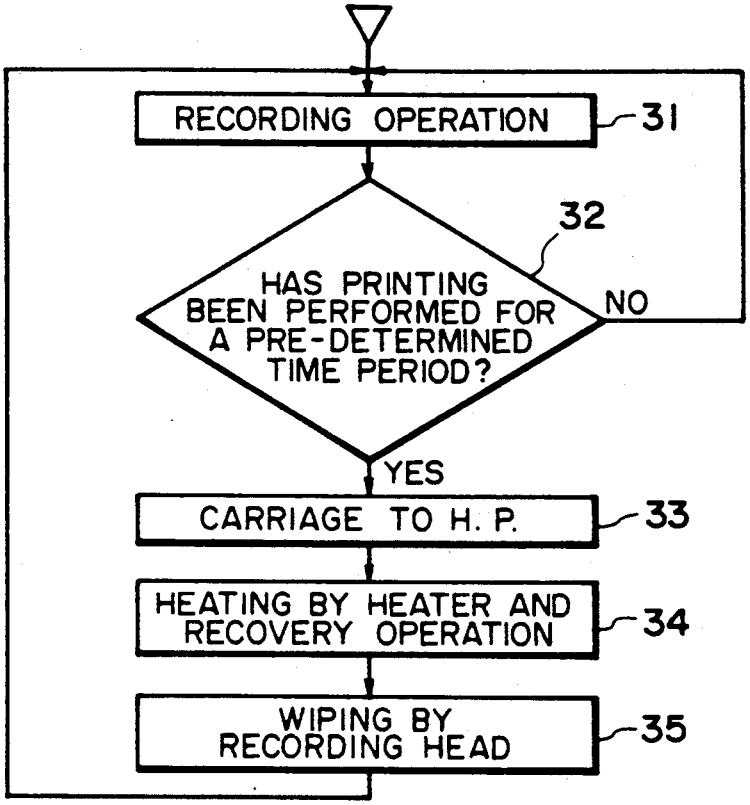
FIG. 13 is a flow chart showing the automatization of the discharge recovery operation according to the present invention.

FIG. 13 is a flow chart in a case where the discharge recovery according to the present invention is automatically effected.

After the power source switch is closed, the recording operation is performed (step 31), and in that process, whether a period during which the discharge recovery operation is necessary has come is judged (step 32). When it is judged that printing for a predetermined time has been done, the carriage 23 is returned to its home position (step 33), and electric power is supplied to the heater 5 (or depending on the timing of FIG. 10, to the heater 12 and the heater 5) and the discharge recovery operation by the bubble created thereby is performed (step 34). Then, the carriage 23 is moved rightwardly as viewed in FIG. 12, and in that process, the surface of the head (which is near the discharge openings) is cleaned by the blade 24 (step 35). After this treatment, return is made to the step 31, where the recording operation is resumed.

Although at the step 32, the judgment condition has been "printing for a predetermined time", it may also be "stoppage of printing for a predetermined time". Also, the "recording operation" of the step 31 after the closing of the power source switch has been made reliable, but a recovery operation of the same content as the step 34 may be inserted before the step 31. If this is done, even if the apparatus remains unused for a long time before the closing of the power source switch, unsatisfactory discharge will not be caused in the recording at the step 31.

Figure 14:
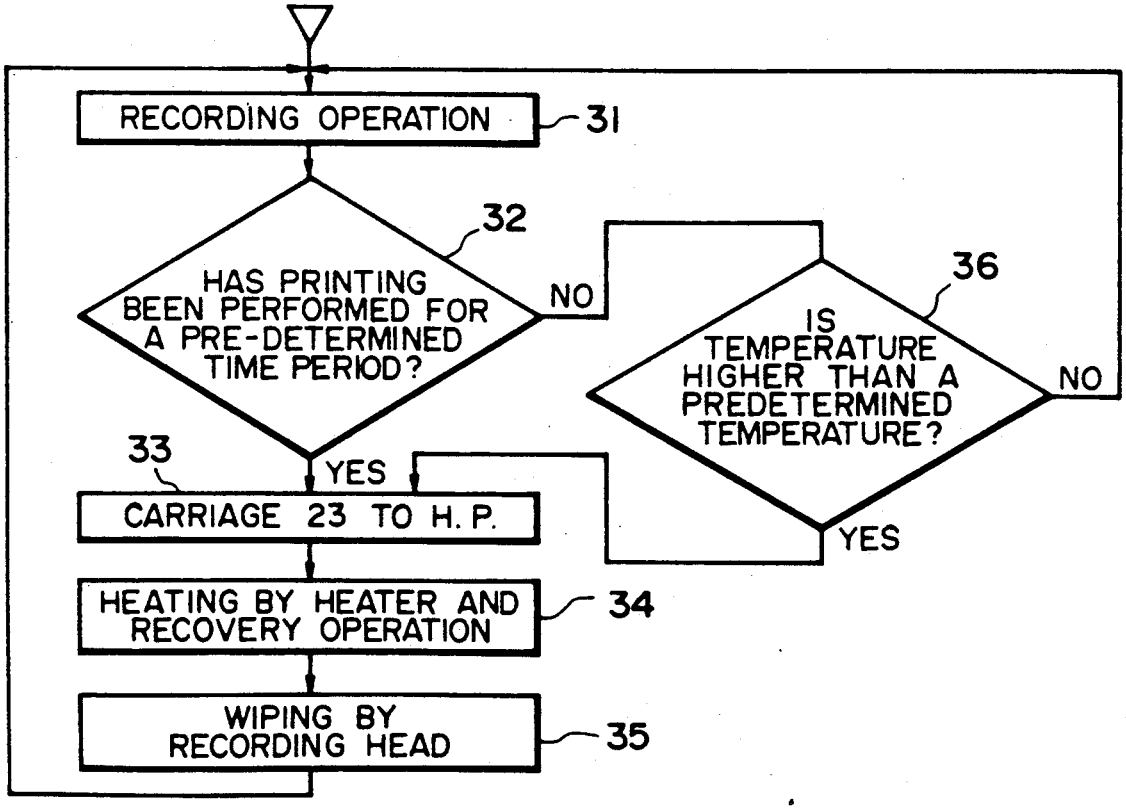
FIG. 14 is a flow chart showing another example of the automatization of the discharge recovery operation.

Also, the step 32 may be the condition for the completion of printing of a predetermined number of sheets (or a predetermined number of pages), instead of the process content of FIG. 13. Further, as shown in FIG. 14, step 36 may be provided with a view to remove any remaining air created by the heaters 3 for recording with the rise of the head temperature caused by the continuous use of the nozzle.

As the driving condition for the heater for applying pressure, the pre-discharge operation is effected a plurality of times as one recovery operation, and in order to make the amount of heat energy produced by the heater for applying pressure in one pre-discharge operation greater than the amount of heat energy produced by the heaters for recording in one discharge operation, where the materials and the film thicknesses of said heaters are the same, design is made such that the following relation is established when the area of the heaters k for recording is $a_k$ and the area of the heater for applying pressure is b:

$$b > \sum_{k=1}^{N} a_k \text{ (}N\text{ is the number of heaters for recording.)}$$

and more preferably, $$b \geqq 2 \cdot \sum_{k=1}^{N} a_k,$$

whereby the frequency of application of the pre-discharge signal could be reduced.

The position of the heater for applying pressure will now be described with reference to FIG. 15.

Figure 15:
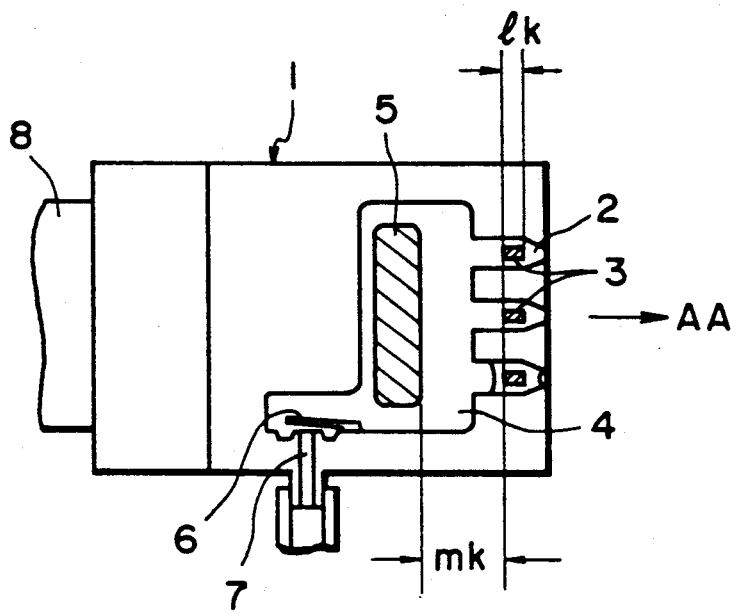
FIG. 15 illustrates the position of a heater for applying pressure.

The recording head schematically shown in FIG. 15 is a head of the type in which ink is discharged in a direction substantially parallel to the surface of the heat generating portion of the heaters for recording (the direction of arrow AA). When the length of said heat generating portion in the direction of discharge (the arrow AA) is $l_k$ and the spacing between the heaters 3 for recording and the heater 5 for applying pressure is $m_k$, it is desirable to determine the positions of these heaters so as to satisfy the relation that $$m_k \geqq l_k \text{ or } m_k \geqq \sqrt{a_k}\ .$$

This is because the bubbles created by the heat generation of the heaters for recording tend to stagnate within the range of the distance $l_k$ rearward of the heaters for recording, and according to the heater for applying pressure thus disposed, said stagnant bubbles can be discharged well through the discharge openings, or by the cavitation action of the heater for applying pressure, there works strongly the action of catching and gathering the bubbles in the liquid chamber if the bubbles are not discharged through the discharge openings, and exhausting the bubbles from a vent hole or the like, not shown, to the outside.

Figure 16:
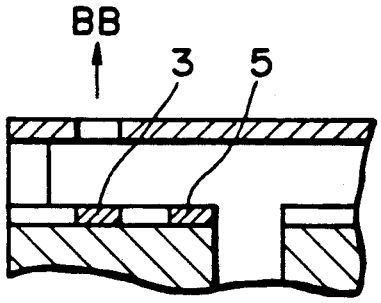
FIG. 16 is a fragmentary cross-sectional view of an example of the recording head to which the present invention can be applied.

Also, as a recording head to which the present invention is applicable, in a head of the type which discharges ink in a direction substantially perpendicular to the surface of the heat generating portion of the heaters for recording (the direction of arrow BB in FIG. 16), it is rarely the case that the stagnation of bubbles occurs at a position greatly spaced apart from the surface of the heat generating portion and therefore, the above-described position is not restrictive, but it is still preferable to provide a heater for applying pressure at a similar position.

As is apparent from the foregoing description, in the present invention, by providing the heater for applying pressure discretely from the heaters for recording, unsatisfactory discharge which could not be released by the conventional pre-discharge operation can be released to thereby accomplish a good discharge recovery operation without shortening the life of the heaters for recording.

Further, the heater for applying pressure can be made into desired structure and moreover can be disposed more adjacent to the heaters for recording and therefore, it becomes possible to produce a pressure force at a location whereat bubbles or foreign materials are ready to stagnate, and the efficiency of discharge recovery can be remarkably improved without discharging a great deal of ink.

We claim:

1. A discharge recovery method for an ink jet recording head including discharge openings capable of discharging ink therefrom, liquid paths connected to the discharge openings, and a liquid chamber in communication with the liquid paths for supplying ink thereto, with heat energy generating members for recording being provided proximate to or in the liquid paths and heat energy generating means being provided in the liquid chamber, the method comprising the steps of:

driving the heat energy generating members in a recording mode, wherein ink is discharged through selected discharge openings to effect recording; and driving the heat energy generating means so as to generate heat energy for discharging ink only in a non-recording mode, wherein ink is discharged through selected discharge openings but recording is not effected.

2. A discharge recovery method according to claim 1, further driving the heat energy generating means when the recording mode is continuously ceased for a predetermined time.

3. A discharge recovery method according to claim 1, further driving the heat energy generating means after a predetermined amount of recording is effected.

4. A discharge recovery method for an ink jet recording head including discharge openings capable of discharging ink therethrough, with heat energy generating members for recording being provided proximate to the discharge openings, first heat energy generating means being provided at an upstream side of an ink supply path with respect to the heat energy generating members, and second heat energy generating means provided proximate to a supply opening at an upstream side of the ink supply path with respect to the first heat energy generating means, the method comprising the steps of:

driving the heat energy generating members in a recording mode, wherein energy is generated for discharging ink through selected discharge openings to effect recording;

driving the second heat energy generating means to generate energy for causing a change in the state of the ink and creating a bubble therein to block the supply opening in a non-recording mode; and driving the first heat energy generating means to generate energy for creating a bubble in the ink only in the non-recording mode, wherein ink is discharged through selected discharge openings but recording is not effected.

5. A discharge recovery method according to claim 4, further comprising the step of using electro-thermal converting members as the first and second heat energy generating means.

6. A discharge recovery method according to claim 4, further comprising the step of applying, to the first heat energy generating means, a first pulse signal and a second pulse signal smaller in pulse width than the first pulse signal.

7. A discharge recovery method according to claim 4, further comprising the step of applying, to the second heat energy generating means, a first pulse signal and a second pulse signal smaller in pulse width than the first pulse signal.

8. A discharge recovery method according to claim 6, and further applying the pulse signals at a predetermined timing.

9. A discharge recovery method according to claim 7 and further applying the pulse signals at a predetermined timing.

10. An ink jet recording head comprising:

structural means for defining discharge openings capable of discharging ink therethrough, liquid paths in communication with the discharge openings, a liquid chamber for supplying ink to the liquid paths and a supplying opening in said liquid chamber;

first electro-thermal converting means, disposed proximate to or in the liquid path, for generating heat energy to discharge the ink through selected discharge openings to effect recording in a recording mode;

second electro-thermal converting means, disposed proximate to or in the liquid chamber, for generating heat energy for causing a change in the state of the ink in the liquid chamber and creating a bubble therein only during a non-recording mode, wherein ink is discharged but recording is not effected; and flow checking means disposed proximate to said supply opening for inhibiting flow therethrough when a bubble is created in the liquid chamber by said second electrothermal converting means.

11. An ink jet recording head according to claim 10, wherein the heat energy generated by said second electro-thermal converting means is greater than the heat energy generated by said first electro-thermal converting means.

12. An ink jet recording head according to claim 10, wherein said second electro-thermal converting means has a larger heat generating area than said first electro-thermal converting means.

13. An ink jet recording head according to claim 10, wherein said flow checking means includes a check valve disposed in the liquid chamber.

14. An ink jet recording head according to claim 10, wherein said flow checking means includes bubble creating means, disposed in the liquid chamber, for creating a bubble near the supply opening.

15. An ink jet recording head according to claim 14, wherein said bubble creating means is an electro-thermal converting member.

16. An ink jet recording head according to claim 10, further comprising an ink tank for containing the ink to be supplied to the liquid chamber.

17. An ink jet recording head according to claim 16, wherein said recording head and said ink tank are removably mounted.

18. An ink jet recording head according to claim 10, wherein the distance between said second electro-thermal converting means and said first electro-thermal converting means is equal to or greater than the length of said first electro-thermal converting means.

19. An ink jet recording head according to claim 10, wherein the ink is discharged in a direction substantially parallel to a longitudinal surface of a heat generating portion of said first electro-thermal converting means.

20. An ink jet recording head according to claim 10, wherein the ink is discharged in a direction intersecting a longitudinal surface of a heat generating portion of said first electro-thermal converting means.

21. An ink jet recording apparatus comprising:

a recording head having discharge openings capable of discharging ink therethrough, liquid paths communicating with the discharge openings, a liquid chamber communicating with the liquid paths, first heat energy generating members provided proximate to or in the liquid paths, and a second heat energy generating member provided proximate to or in the liquid chamber;

recording signal generating means for inputting a recording signal to selected said first heat energy generating members in a recording mode, wherein ink is discharged through selected discharge openings to effect recording; and pre-discharge signal generating means for inputting a signal to said second heat energy generating member and causing a change in the state of the ink to create a bubble in the liquid chamber only in a non-recording mode, wherein ink is discharged but recording is not effected.

22. An ink jet recording apparatus according to claim 21, further comprising a carriage for carrying said recording head thereon and being movable, wherein said pre-discharge signal generating means generates a signal when said carriage is positioned in a non-recording area.

23. An ink jet recording apparatus according to claim 21, wherein said recording signal generating means and said pre-discharge signal generating means includes a control circuit.

24. An ink jet recording apparatus according to claim 21, wherein said pre-discharge signal generating means generates a first pulse signal and a second pulse signal greater in pulse width than the first pulse signal.

25. An ink jet recording apparatus according to claim 21, wherein said recording head has an ink tank containing ink to be supplied to said recording head, and a carriage for removably carrying said ink tank.

26. An ink jet recording apparatus according to claim 21, wherein said first and second heat energy generating means are electro-thermal converting members.

27. An ink jet recording apparatus according to claim 21, wherein said recording head is provided with temperature detecting means, and said pre-discharge signal generating means generates a signal on the basis of the temperature detected by said temperature detecting means.

* * * * *

UNITED STATES PATENT AND TRADEMARK OFFICE

CERTIFICATE OF CORRECTION

PATENT NO. : 5,053,787

DATED : October 1, 1991

INVENTOR(S) : KOJI TERASAWA, ET AL.

It is certified that error appears in the above-identified patent and that said Letters Patent is hereby

ON THE TITLE PAGE,
BEFORE RELATED U.S. APPLICATION DATA

Insert: -- [30] Foreign Application Priority Data

Jan. 27, 1988 [JP] Japan ..... 63-16491
Jan. 27, 1988 [JP] Japan ..... 63-158321
Jan. 23, 1989 [JP] Japan ..... 1-13592 --.

IN [56] REFERENCES CITED

Under U.S. PATENT DOCUMENTS, "Terashawa" should read --Terasawa--.

COLUMN 1

Line 21, "recording,." should read --recording--.

COLUMN 4

Line 11, "form" should read --from--.
Line 49, "checking In" should read --checking. In--.

COLUMN 9

Line 62, "claim 7" should read --claim 7,--.

COLUMN 10

Line 4, "path," should read --paths,--.
Line 18, "electrothermal" should read --electro-thermal--.

UNITED STATES PATENT AND TRADEMARK OFFICE

CERTIFICATE OF CORRECTION

PATENT NO. : 5,053,787

DATED : October 1, 1991

INVENTOR(S) : KOJI TERASAWA, ET AL.

It is certified that error appears in the above-identified patent and that said Letters Patent is hereby corrected as shown below:

COLUMN 12

Line 11, "means" should read --members--.

Signed and Sealed this

Thirty-first Day of May, 1994

Bruce Lehman

*Attest:*

BRUCE LEHMAN

*Attesting Officer*

*Commissioner of Patents and Trademarks*